United States Patent [19]

Janson

[11] 4,134,177

[45] Jan. 16, 1979

[54] COUNTERWEIGHT CARRIAGE FRAME FOR STAGE CURTAINS AND THE LIKE

[76] Inventor: Richard W. Janson, P.O. Box 8110, Canton, Ohio 44711

[21] Appl. No.: 760,861

[22] Filed: Jan. 21, 1977

Related U.S. Application Data

[63] Continuation-in-part of Ser. No. 617,508, Sep. 29, 1975, Pat. No. 4,014,071.

[51] Int. Cl.[2] ..... A47H 15/00

[52] U.S. Cl. ..... 16/96 D; 254/141

[58] Field of Search ..... 16/96 D, 93 D, 94 D, 16/95 D, 87.4; 160/189, 190, 193; 254/141; 187/95

[56] References Cited

U.S. PATENT DOCUMENTS

| | | | |
|---|---|---|---|
| 649,729 | 5/1900 | Isbills | 16/93 D |
| 1,296,422 | 3/1919 | Morris | 254/141 |
| 1,434,189 | 10/1922 | Bennett | 139/92 |
| 1,605,258 | 11/1926 | Meiszner | 16/93 D |
| 1,912,829 | 6/1933 | Crume | 160/190 |
| 1,912,830 | 6/1933 | Crume | 160/190 |
| 2,216,682 | 10/1940 | Zurcher et al. | 139/92 |
| 2,510,404 | 6/1950 | Lare et al. | 139/82 |
| 2,608,216 | 8/1952 | Kaufmann | 139/92 |
| 2,668,559 | 2/1954 | Leveque | 139/92 |
| 2,674,273 | 4/1954 | Blickenstorfer | 139/92 |
| 2,674,274 | 4/1954 | Blickenstorfer | 139/92 |
| 2,674,275 | 4/1954 | Blickenstorfer | 139/92 |
| 2,708,455 | 5/1955 | Kaufmann | 139/92 |
| 2,727,272 | 12/1955 | Hankin et al. | 16/93 D |
| 2,874,726 | 2/1959 | Kaufmann | 139/92 |
| 3,151,666 | 10/1964 | Ford | 160/346 |
| 3,165,296 | 1/1965 | Drew | 254/141 |
| 3,314,470 | 4/1967 | Janson et al. | 160/347 X |
| 3,690,617 | 9/1972 | Butler | 254/141 |
| 3,697,047 | 10/1972 | Cruse | 254/141 |

FOREIGN PATENT DOCUMENTS

| | | | |
|---|---|---|---|
| 1143458 | 2/1963 | Fed. Rep. of Germany | 139/92 |
| 846983 | 9/1939 | France | 139/92 |
| 1181962 | 1/1959 | France | 139/92 |
| 958059 | 9/1949 | France | 139/91 |
| 99773 | 2/1962 | Norway | 160/345 |
| 273917 | 6/1951 | Switzerland | 139/92 |
| 274498 | 6/1951 | Switzerland | 139/91 |
| 896118 | 5/1962 | United Kingdom | 160/347 |

OTHER PUBLICATIONS

Advertisement, "Ganzmetallwebschaft" Mar. 1952, p. 4.

*Primary Examiner*—Ronald Feldbaum
*Attorney, Agent, or Firm*—Mason, Mason and Albright

[57] ABSTRACT

A framework in a counterweight assembly for carrying weight which counterbalances the weight of stage curtains and the like, the framework having upper and lower identical extruded bars, each including a cylindrical portion on one longitudinal edge and a bifurcated portion on the opposite longitudinal edge provided with outwardly extending flanges, the bifurcated portion defining a continuous groove. The groove faces inwardly and the cylindrical portion faces outwardly with the upper and lower bars being connected by a pair of side rods, also extruded aluminum, each side rod including a tongue along a longitudinal edge adapted to be received by the aforesaid groove and a guide being provided on the opposite longitudinal edge, such guide being received in a vertical guide beam for guiding the framework in its vertical movement. A groove of cruciform cross-section extends across the outward facing sides of each cylindrical portion, such groove providing for the attachment of cables which function to move the counterweight carriage up and down when the stage curtains or the like are raised or lowered. The horizontal bars and the vertical rods are fastened together through the bifurcated portion and the tongues received therein. Axles with wheels are journalled periodically along at least one of the guides of the side rods, such wheels being received in the guide beam to reduce friction and improve the performance of the counterweight assembly.

14 Claims, 27 Drawing Figures

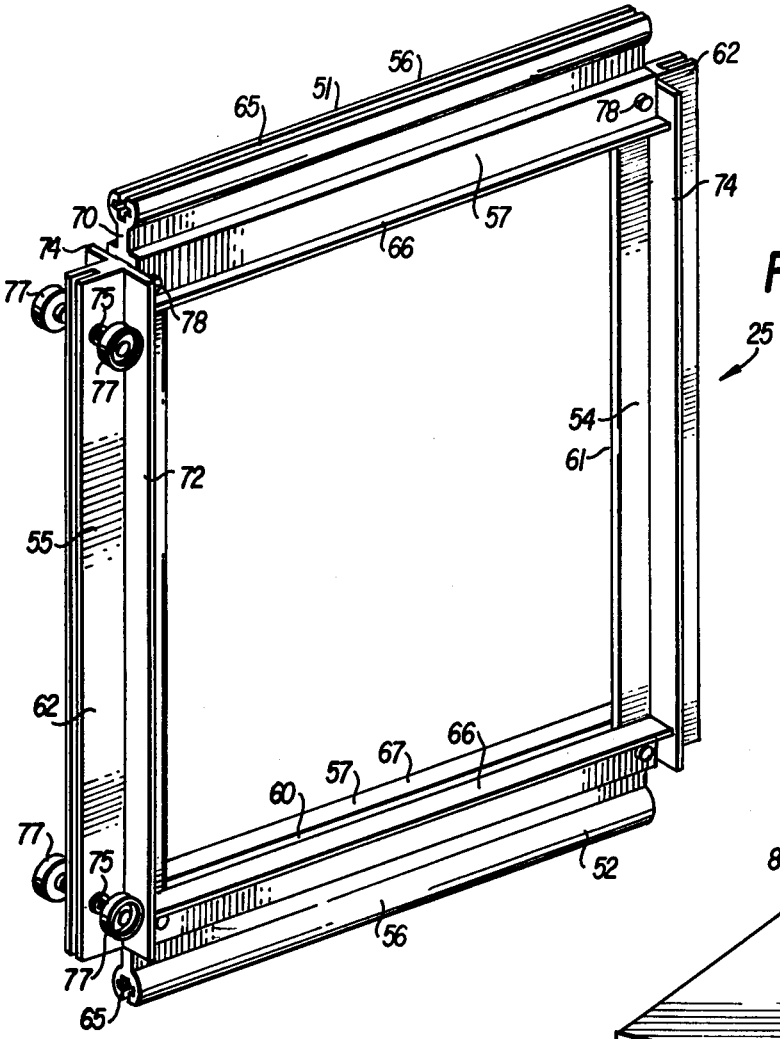
FIG. 2
FIG. 6
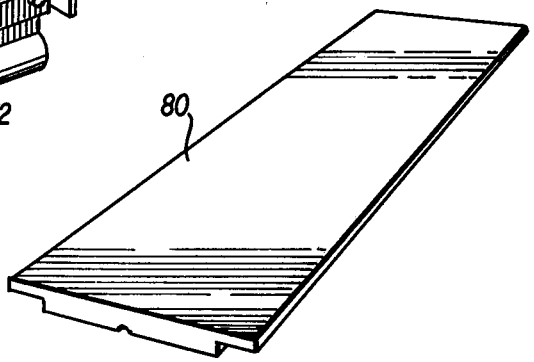
FIG. 7
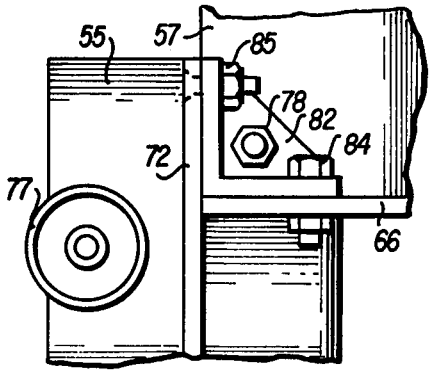
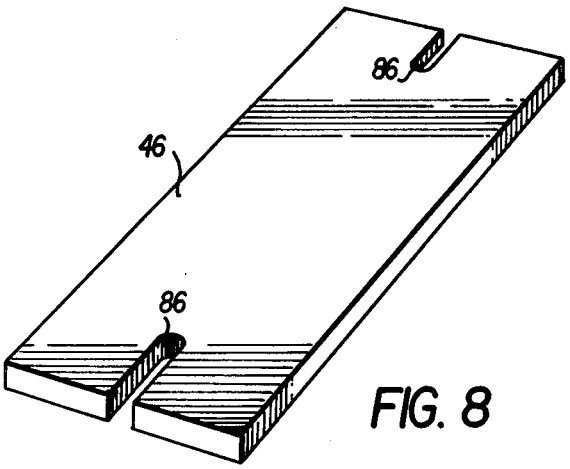
FIG. 8

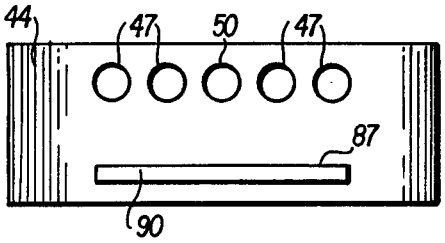
FIG. 9A
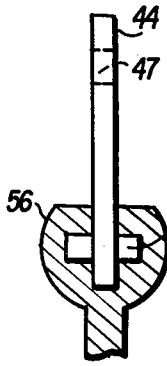
FIG. 9B
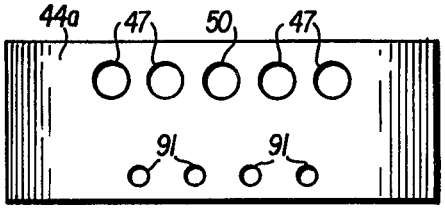
FIG. 10A
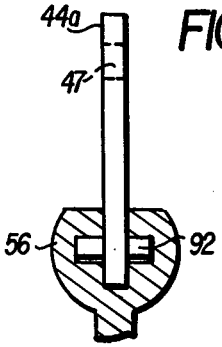
FIG. 10B
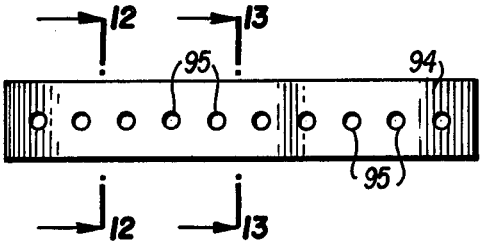
FIG. 11
FIG. 12
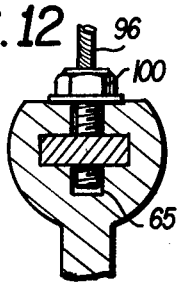
FIG. 13
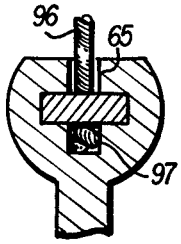
FIG. 14A
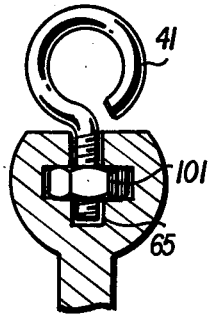
FIG. 14B
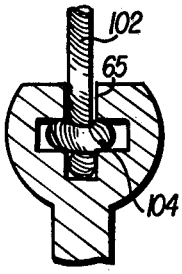
FIG. 14C
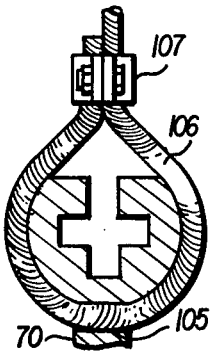
FIG. 14D
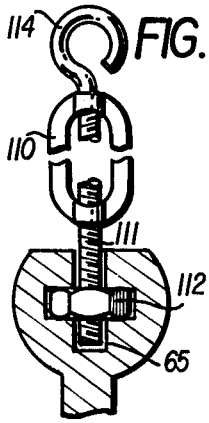
FIG. 20A
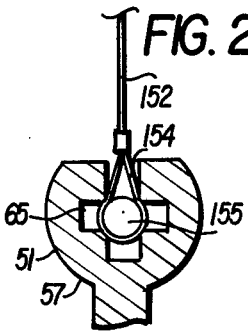
FIG. 20B
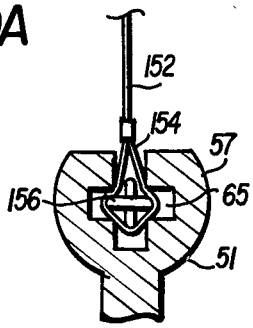

COUNTERWEIGHT CARRIAGE FRAME FOR STAGE CURTAINS AND THE LIKE

RELATED APPLICATIONS

This is a continuation in part of my application Ser. No. 617,508 which was filed Sept. 29, 1975 U.S. Pat. No. 4,014,071.

BACKGROUND OF THE INVENTION

The invention relates to a vertically movable framework to receive weights for counterbalancing stage curtains and the like and more particularly to the type of counterweight carriage which is guided in its vertical movements.

In theaters where curtains and scenery are moved vertically, counterweight arbors or carriages are utilized to counterbalance the weight of the curtain or scenery or whatever may be moved vertically onto and from the stage. Conventional counterweight carriage designs currently used in the stage and theater industry have tops and bottoms of the arbors which are of cast iron manufacture. Frequently the techniques of casting result in inaccuracies in the alignment of the top of the arbor with the back plate which occasion additional time on the job for grinding, realignment and shimming as may be necessary. Further, inaccuracies in the carriage construction may add friction and poor performance in the guidance of the counterweight assembly. It thus has been evident for some time that an improved counterweight carriage assembly is needed which will provide an effective relatively frictionless means for raising and lowering stage curtains and the like and which at the same time can be installed without undue labor cost or a high skill level requirement. It has occurred to the inventor that the existing problems may be solved through a proper design utilizing heavy duty aluminum extrusions adaptable to a variety of conditions encountered in various theaters.

SUMMARY OF THE INVENTION

The invention is primarily directed to individual components for a counterweight carriage assembly which is intended for heavy duty use for the suspension of curtains in large theaters and the like. The individual components are designed to cooperate whereby they facilitate the installation of the curtain suspension system, are adaptable to numerous construction variations which may be encountered, and which provide an improved counterweight system for the smooth and effective raising of large curtains and the like.

The invention involves three basic types of extrusions. These constitute an extruded bar for the upper and lower bars of the counterweight carriage framework, each such bar including a substantially cylindrical portion along one longitudinal edge thereof which is provided with a slot having a cruciform cross-section. This particular slot design has been found particularly adaptable to cooperate with various types of suspension devices. The other side of the bar includes a bifurcated portion which defines a continuous groove and a pair of outwardly extending flanges which receive the weights carried by the framework. Another of the basic extrusions is for the side rails or rods which includes a tongue along one longitudinal edge and guidance means on the opposite longitudinal edge with an outwardly extending flange between such portions and perpendicular thereto. The tongue is adapted to be received in the grooves of the top and bottom rods which are assembled so that the cylindrical portion faces up at the top and down at the bottom and wherein each tongue may be secured by bolts or the like to the top and bottom rods. The guidance means extend outwardly. The other basic type extrusion constitutes a beam which is designed to cooperate with the guidance means to provide a vertically disposed path for guiding the counterweight frame in its vertical movement. The guidance means have journalled therein axles with wheels at their ends which are received in the vertical guide beam to facilitate the relative vertical movement of the guidance means. The latter extrusion further includes slots for receiving alignment and splice bars to ensure the proper alignment of sections of the guide beams as and where may be necessary.

The combination of the first two mentioned extrusions results in a counterweight carriage assembly which is a rigid, unitary structure that does not twist or distort easily. The cooperation of the guidance means with the guide beams, the wheels of the former received in a guide track of the latter, maintains the weight loaded counterweight carriage in plumb and in a linear path while moving. The advantage of the rolling wheels over conventional shoes used in standard stage counterweight arbors is in the elimination of the friction and interruption of movement particularly at splices in the counterweight track. Moreover, this design greatly reduces the number of parts in what would otherwise be the shoe assembly. Still further, installation is speeded and the cost of manufacture is reduced.

The cylindrical portions of the upper and lower bars provides for receipt of a one-fourth inch cable without the use of cable thimbles. An alternative method of cable connection is use of a trim chain in the slotted counterweight carriage top. The design of the groove therein permits use of a chain dead-off without bolting or the insertion of a bolt without drilling if this is desired. The design also permits the safety locking of arbors in a positive manner.

The side rod extrusion not only provides for the guidance of a counterweight in accordance with the instant invention by the rolling wheels in the guide beam extrusion, but in addition, may be used with conventional "Tee" guide assemblies or cable guides used on conventional stages. Further, the channel design of the guide beam provides for the direct bolting of the track to horizontal wall battens which are used in conventional stage design. However, due to the structural properties of the guide beam, the number of wall battens may be substantially reduced from say five foot centers to twelve foot centers, thus effecting a substantial reduction in time for the installation and total cost of the system.

Other adaptabilities and capabilities of the invention will be appreciated by those skilled in the art as the description progresses, reference being had to the accompanying drawings, in which:

BRIEF DESCRIPTION OF THE DRAWINGS

FIG. 2 is a perspective view of the counterweight arbor in accordance with the invention;

FIG. 6 is a perspective view of a splice bar which is utilized for aligning and splicing together vertical beams as shown in cross section in FIG. 5;

FIG. 7 illustrates in broken side elevation a structure for securing an upper bar to a side rod in the arbor assembly;

FIG. 8 is the perspective view of a weight plate which is used in conjunction with the arbor as shown in FIG. 2;

FIGS. 9A and 9B show a cable attachment plate in front elevation and in side elevation within the cruciform slot of an upper rod, respectively;

FIGS. 10A and 10B disclose a modified cable attachment plate in views similar to those utilized in FIGS. 9A and 9B;

FIG. 11 discloses a further modified embodiment of a cable attachment plate;

FIG. 12 is a side elevational view of a rod with the plate shown in FIG. 11 taken on lines 12—12 of FIG. 11;

FIG. 13 is a view similar to FIG. 12 taken on section lines 13—13 of FIG. 11;

FIGS. 14A, 14B, 14C and 14D show various arrangements for connecting cables or devices for connection to cables within the cruciform slots of the extruded upper and lower bars.

FIGS, 20A and 20B disclose sectional views illustrating different arrangements for securing a screen in the cruciform slot of the bar disclosed in FIG. 3.

DESCRIPTION OF THE PREFERRED EMBODIMENTS

Figure 1:
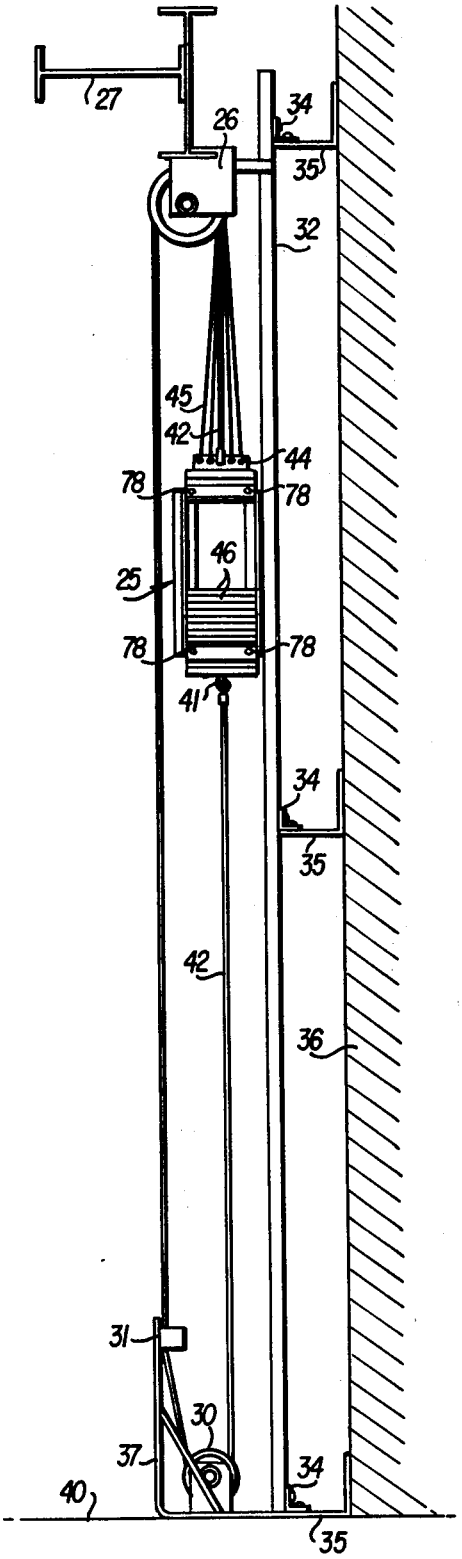
FIG. 1 is a side elevation illustrating a counterweight system including the counterweight arbor of the invention.

Referring to FIG. 1, a counterweight system for a stage curtain is shown. This system includes a counterweight arbor or carriage 25, a head block 26 which is interconnected to a bracer beam 27 in the upper part of the stage, a floor block 30, a cable lock 31, and a guide beam 32 which is connected by angle wall battens 34 and wall knee brackets 35 to the finished wall 36 of the stage. The cable lock 31 and floor block 30 are mounted on an L bracket 37 which is secured to the stage deck 40. An eye bolt 41 depending from the carriage 25 receives a hoisting cable 42 which turns about a pulley in the floor block 30, extends through cable lock 31, is received by a further pulley in head block 26 and finally is secured to a cable attachment plate 44 secured to the upper part of carriage 25. A further plurality of cables 45 extending from plate 44 are also received in grooves of the pulley of head block 26 and extend laterally to support a stage curtain and the like in a manner well known in the art.

The counterweight carriage 25 carries a plurality of counterweight plates 46 which function to counterbalance the weight of the stage curtain and the like supported by cables 45. Each cable 45 is secured through an opening 47 of plate 44 and cable 42 is secured to a central opening in plate 44, such opening being designated by reference numeral 50. (See FIGS. 9A and 10A)

With cable lock 31 in position so that hoisting cable 42 can pass freely therethrough, the curtain or the like supported by cables 45 is raised by pulling the hoisting cable 42 downwardly between the eye bolt 41 and block 30 and is lowered by manually pulling the cable 42 downwardly between head block 26 and cable lock 31.

Referring to FIG. 2, the counterweight carriage 25 without the counterweight plates 46 is shown. It will be noted that carriage 25 comprises a framework constructed of an upper bar 51 and a lower bar 52. These are connected by a pair of vertically extending side rails or rods 54 and 55. Bars 51 and 52 have identical cross sections (see FIG. 3) and lengths. Each comprises a cylindrical portion 56 and a bifurcated portion 57, the latter defining a continuous groove 60 which receives a tongue 61 of each side rod 54. The side rods 54 and 55 are also of identical cross section (See FIG. 4) and have the same height. Opposite tongue 61 in each side rod is a guide means 62 which defines a vertical slot 64.

Figure 3:
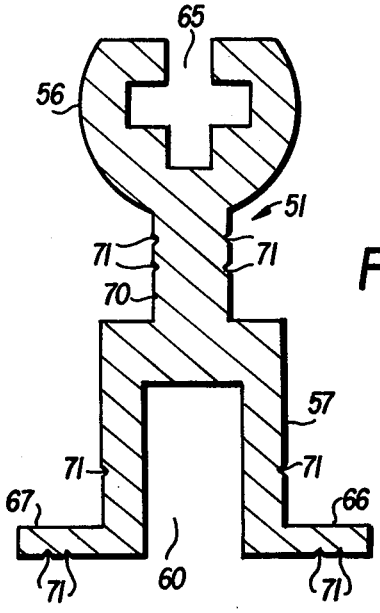
FIG. 3 is a cross sectional view of the upper and lower bars of the arbor shown in FIG. 2.
Figure 4:
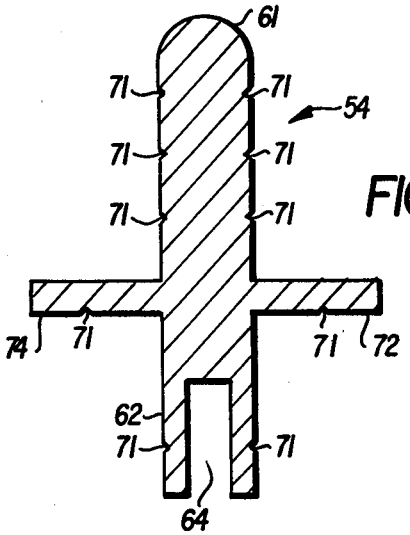
FIG. 4 is a cross sectional view of the side rods of the arbor shown in FIG. 2.

At the outward side of each cylindrical portion 56 is a connection means 65 which comprises a slot having a cruciform cross section. Extending outwardly in the same plane from the inboard side of groove 60 of bifurcated portion 57 are a pair of flanges 66 and 67. Portions 56 and 57 are joined by a neck portion 70. In extruding the bars 51 and 52 as shown in FIG. 3, a plurality of scores 71 are provided therein. The purpose of scores 71 is to provide a means for centering drills for providing holes as desired through the various portions of bars 51 and 52. It will be noted that similar scores are provided on the extruded parts comprising side rods 54 and 55 as shown in FIG. 4, such scores again being designated by reference numeral 71. From FIGS. 2 and 4, it will be noted that side rods 54 and 55 include a pair of flanges 72 and 74 which served the purpose of restricting the side rods from twisting and also assisting in retaining counterweight plates 46 in place. The side rods 54 and 55 are connected rigidly to the upper and lower bars 51 and 52 by fastening means 78 comprising nuts and bolts, the bolts extending through aligned bores through the bifurcated portion 57 and tongues 61. In practice, the over-all width between the extremities of flanges 66 and 67 is the same as that between flanges 72 and 74, such width in current practice being three inches.

Figure 5:
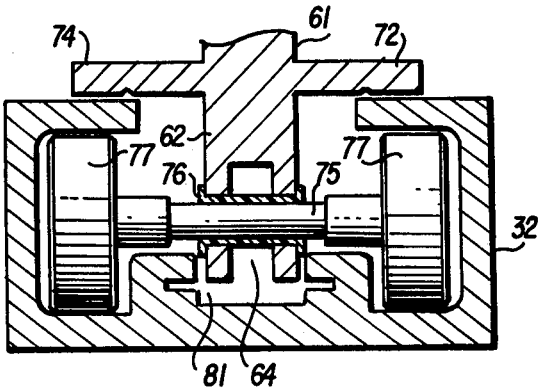
FIG. 5 is a cross sectional view showing a guide beam receiving the guide member of a side rod of the arbor, an axle with wheels mounted thereon being journalled in the guide member.

Journalled into the guide means 62 of side rod 55 are a pair of axles 75 carries by bearing inserts 76, the axles mounting each a pair of wheels 77 as shown in FIG. 5.

It will be noted from FIG. 5 that wheels 77 are surrounded on three sides by the guide beam 32 and, inasmuch as each of the wheels 77 has a diameter somewhat less than the interior width of the beam 32, they are received in contact with a track either on one side or the other but not both of the opposing interior surfaces of beam 32. However, it is to be understood that with the wheel 77 contacting the interior portions of the beam 32 on the track of either side, the flanges of 72 and 74 are, nevertheless, maintained out of contact, although adjacent to, beam 32. In the event that beam 32 is made up of two or more lengths which are spliced together, a splice bar 80 is employed which is snugly received in a T-shaped slot 81 of the extruded beam 32. The splice bar 80 is placed so as to bridge within slot 81 a pair of end-to-end abutting beams 32 and is bolted or otherwise rigidly secured in slot 81 to both abutting beams 32.

FIG. 7 shows a corner bracket 82 whereby bars 51 and 52 are secured more firmly, if desired, to side rods 54 and 55. Thus, corner bracket 82 is bolted rigidly to portion 57 and tongue 61 in underlying groove 60 by means of fastening means 78 as previously described. Although, in this case, the bolt is somewhat longer whereby it can be received through aligned bores which include corner brackets 82 on either side of bar 51. Further nut and bolt fastening means 84 and 85 are provided through bracket 82 and flanges 66 and 72 respectively, the bolt through the flanges 72 on one side and 74 on the other being provided with a substantially flat head so that it does not interfere in relative movement with the beam 32 although the latter is not illustrated in FIG. 7.

A counterweight plate 46 is illustrated in FIG. 8, the length of the plate 46 being such as to fit between flanges 72 and 74 of opposing rods 55 and 54. In a similar manner, the width of plate 46 is preferably the same as the width as between the outboard edges of the flanges 66 and 67. The thickness may be the same as or slightly less than that of slot 65. Slots 86 provided in plates 46 are adapted to receive tongues 61 whereby the counterweight plate 46 is maintained in place as illustrated in FIG. 1. Plates 46 are usually constructed of steel but may be composed of another heavy material such as, for example, lead.

The cable attachment plate 44 illustrated in FIGS. 9A and 9B has a predetermined thickness so that it is snugly but slideably received vertically in the cruciform slot 65. It is provided in its lower portion with a rectangular opening 87 which snugly receives a cross-bar 90 which, itself, is snugly but received in a horizontal position in the cruciform slot 65 as shown in FIG. 9B. The openings 47 and 50 are drilled in horizontal axes through the plate 44 for receiving the cables 45 and 42 as shown in FIG. 1.

An alternative attachment plate 44*a* is shown in FIGS. 10A and 10B, such plate being identical to plate 44 except instead of a rectangular opening 87, a series of holes 91 are drilled through the plate 44*a* whereby they receive metal dowels 92 which fit snugly within the horizontal portion of the cruciform slot 65. It is sometimes desirable to utilize a plate 46 as an attachment plate similar to plate 44*a* at the top or bottom or both of carriage 25 to increase the weight of same.

An important aspect of the upper and lower bars 51 and 52 lies in their adaptability for various types of connections. Examples are illustrated in FIGS. 12 through 14D. Thus, in FIGS. 11 – 13, a plate 94 is provided which is snugly but slideably received within the horizontal portion of cruciform slot 65, such plate 94 having a plurality of openings 95 of sufficient diameter to receive cables 96. Such cables 96 are received through openings 95 and knotted at their free end 97 whereby upon sliding the plate 94 into the horizontal portions of slot 65, the knots at the free ends 97 are received in the lower vertical portion of slot 65. In order to ensure that plate 94 is securely affixed relative to the bar 51, one of the openings 95 is threaded to receive a bolt 100, the free end of which bears against the lower portion of slot 65. In FIG. 14A, eye-bolt 41 is threadably received by a nut 101 which is sufficiently large to extend across the horizontal portion of slot 65 so that by tightening eye-bolt 41 against the bottom of the slot 65, a rigid relationship is established, thus securely affixing eye-bolt 41 in its desired location. FIG. 14B discloses a simple use of the cruciform-shaped slot 65 whereby a rope or cable 102 has a knot at its free end which is received in the horizontal portion of slot 65. Its tail 104 is received in the lower portion of the slot 65.

FIG. 14C illustrates an important utility of the cylindrical portion 56 whereby a hole 105 is drilled through the neck portion 70 to receive a cable 106 which thereby forms a loop closed by the clamp 107. With this construction, a one-quarter inch cable may be wrapped around portion 56 without the necessity of employing cable thimbles.

In FIG. 14D, a construction similar to that shown in FIG. 14A is disclosed except that instead of an eye-bolt 41, a turnbuckle 110 is provided which has one threaded end 111 in slot 65 with a nut 112, which threadably receives end 111, extending across the horizontal portion of slot 65, the nut 112 and end 111 preferably being rigidly secured together whereby by turning the turnbuckle 110, the upper eye 114 is raised or lowered due to the opposed nature of the threaded portions extending from turnbuckle 110.

Figure 15:
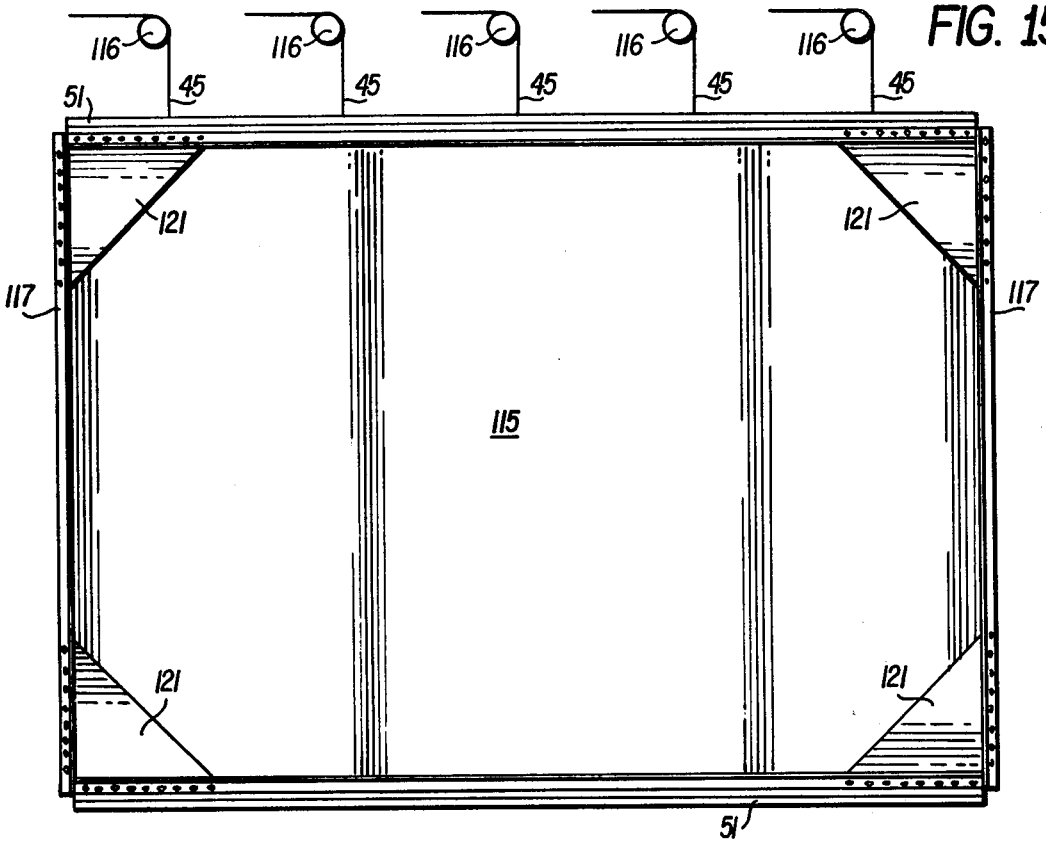
FIG. 15 illustrates an alternate use for the extrusion constituting the upper and lower bars of the counterweight arbor wherein such extrusion is part of a framework for a screen which may be used on a theater stage.
Figure 16:
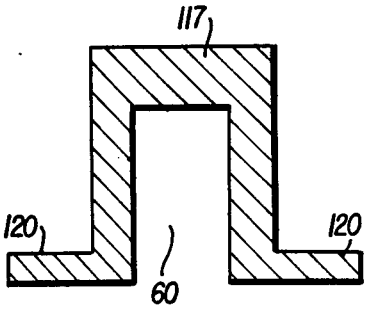
FIG. 16 is a cross sectional view of further extrusion used in the frame shown in FIG. 15.

Bars 51 and 52 have utility other than cooperation within a counterweight carriage such as carriage 25. For example, FIG. 15 discloses a screen 115 which may be utilized in large theatres wherein bar 51 extends completely across screen 115, such screen being supported by a plurality of cables 45 which may be secured within the cruciform-shaped slot of bar 51 as shown in FIGS. 11 – 13 or in FIG. 14B, each of the cables turning about a roller 116 which is supported by structure in the upper part of the stage (not shown). Although the vertical side and lower side of the framework for screen 115 may constitute further bars 51, a variation thereof is shown in FIG. 16 comprising a U-shaped extrusion 117 with flanges 120, such extrusion 117 being identical to bifurcated portion 57 of FIG. 3 except that there is no connection to neck portion 70. As used in FIG. 15, extrusion 117 with bar 51 forms a continuous rectangular slot or groove 60 about the framework. Four by four three-quarter inch plywood squares cut diagonally into equilateral right triangular gussets designated 121 are received in the grooves 60 at the corners thereof and are rigidly secured to the connecting framework portions 51 or 117 whereby a rigid framework as shown in FIG. 15 results. Such framework, is then covered by a screen 115 or other material as desired.

Figure 17:
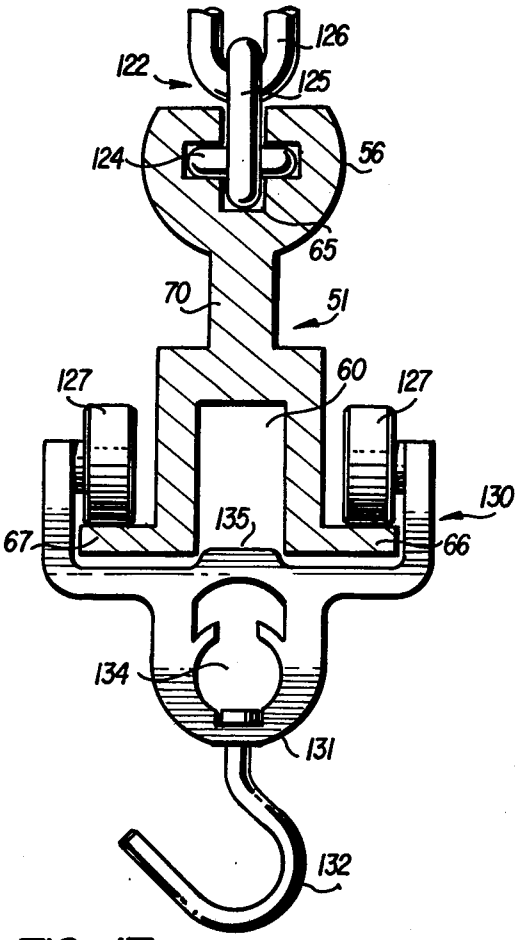
FIG. 17 shows an alternate use for the extrusion illustrated in FIG. 3 wherein it acts as a curtain carrier for heavy curtains as may be found in the larger theaters.

FIG. 17 illustrates the use of bar 51 employed as a suspended curtain rod for heavy stage curtains and the like. Thus, it will be noted that bar 51 is suspended by a link chain 122 which includes a lower link 124, a next to last link 125 and the next higher link 126. The lower link 124 is placed to be received in the horizontal portion of the cruciform slot 65 whereby the next to last link 125 is received in the upper and lower portions of the vertical part of cruciform slot 65. Flanges 66 and 67 receive wheels 127, equipped with rubber or neoprene tires, providing support for the curtain carrier designated generally by reference numeral 130. It will be noted that carrier 130 includes a depending portion 131 which carries a rotatable curtain hook 132 and has extending thereover a horizontal cylindrical opening 134 for frictionally receiving curtain rope. A centrally located protrusion 135 is received in the lower portion of groove 60 to ensure alignment of carrier 130 with bar 51.

Figure 18:
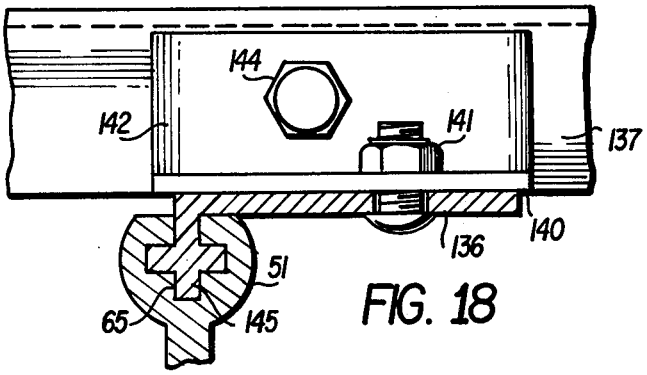
FIG. 18 illustrates a means for supporting the extrusion shown in FIG. 3 on an overhead beam by a horizontal flange member provided with a depending cruciform shaped support part.

In FIG. 18, bar 51 is supported by a bar support 136 which is secured to an overhead beam 137 by means of a horizontal flange member 140 bolted by the nut-and-bolt set 141 to a bracket 142 which in turn is bolted by a further bolt-and-nut set 144 to beam 137. A cruciform-shaped support part 145 is received in the slot 65 of bar 51 thereby providing a firm support for bar 51.

Figure 19:
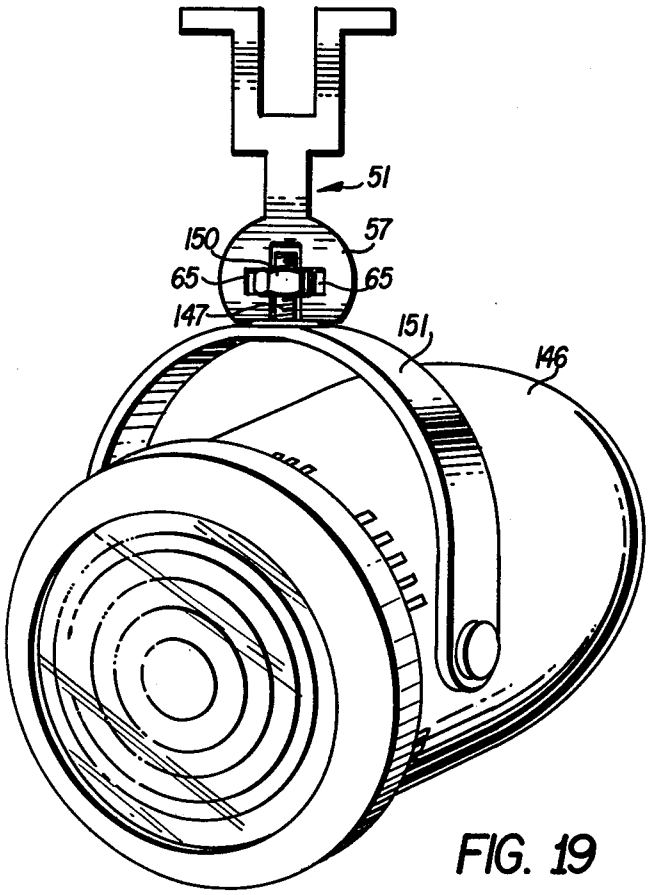
FIG. 19 illustrates a still further use for the extrusion shown in FIG. 3 wherein it supports a stage lamp of the type used in theaters.

In FIG. 19, a stage spotlight 146 is illustrated supported by an overhead bar 51 which is inverted whereby the portion 57 receives a bolt 147 in slot 65, the bolt 147 being threadably received by a nut 150 which extends across the horizontal portion of the slot 65, the bolt 147 also being secured to a hanger 151 from which the spotlight 146 depends.

FIGS. 20A and 20B illustrate the use of bar 51 to receive the lower portion of a screen 152 whereby the screen is formed at its bottom portion into a loop 154 which receives therein a cylindrical rod 155 which is of greater diameter than the width of the vertical portion of slot 65 but also of a diameter not greater than that which permits its insertion, surrounded by the lower loop portion 154 of screen 152, into slot 65. Thus by inserting the loop portion 154 into the slot 65 and then inserting into loop portion 154 the rod 155, screen 152 is securely fastened along one edge defined by the loop 154 to the bar 51. In FIG. 20B a link chain 156 is substituted for rod 155, such link chain 156 having suitable dimensions whereby the loop 154 of screen 152 is retained in place in slot 65 by the insertion of link chain 156 through the interior of loop 154.

Figure 21A:
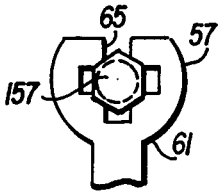
FIGS 21A and 21B illustrate a bolt stop member, side and front view, which may be conveniently received laterally in the cruciform slot of the extruded bar shown in FIG. 3.
Figure 21B:
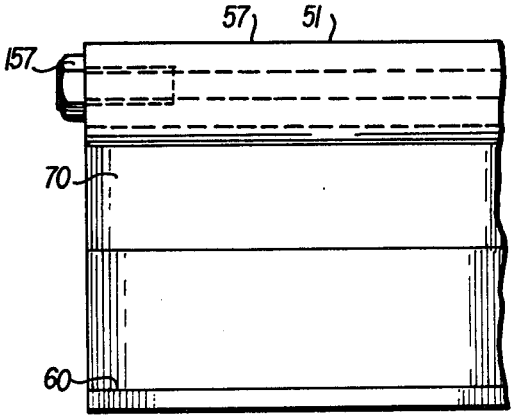

FIGS. 21A and 21B disclose a bolt 157 which is threadably received in slot 65 whereby bolt 157 creates threads in the vertical interior corners created by the cruciform slot, thus constituting a stop at the ends of the cruciform slot 65 to prevent dislodgment of any component received therein such as, for example, plates 44 and **44*a***.

From the foregoing, those skilled in the art will understand that carriage 25 is unique in that rods are not provided to hold the counterweight. Instead extrusions are used which combine the function of such rods and backplates. Moreover, it will be appreciated that the side rods 54 and 55 combined with the upper and lower bars 51 and 52 have a bolted connection which is in shear rather than in tension as in the prior art. A combination of the two extrusions making up the side rods and the upper and lower bars results in a relatively simple assembly which, nevertheless is very rigid and provides a unit structure which resists twisting and other distortion.

Although I have described the preferred embodiments of my invention, those skilled in the art will appreciate that it is capable of other adaptations and modifications within the scope of the appended claims which are therefore intended to cover not only the corresponding structure described in the specification but also equivalents thereof.

Having thus described my invention, what I claim as new and desire by Letters Patent of the United States is:

1. A counterweight carriage frame for stage curtains or the like which comprises: upper and lower bars, each of said bars including a substantially cylindrical portion along one longitudinal edge and a bifurcated portion along the opposite longitudinal edge defining a continuous groove, said groove facing inwardly and said cylindrical portion facing outwardly; a pair of side rods, each said side rod including a tongue along one longitudinal edge and at least one of said rods being provided with guide means along its opposite longitudinal edge, said tongues being received in said grooves to form a rectangular framework with said bars disposed in a parallel relationship on the top and bottom and said rods each connecting said bars at the sides in a perpendicular relationship to said rods; fastening means rigidly affixing said rods to said bars; a vertical guide member providing a verticlaly disposed path receiving said guide means for guiding the counterweight frame in its vertical movement; cable connection means provided in the cylindrical portion of each said bar for the attachment of cable to said framework which function to move the counterweight carriage vertically and simultaneously to raise and lower stage curtains or the like.

2. A counterweight carriage in accordance with claim 1, wherein said cable connection means comprises a slot having a cruciform cross-section provided along the outwardly facing cylindrical portion of each said bar.

3. A counterweight carriage in accordance with claim 1, wherein said guide means includes wheels which cooperate with said guide member.

4. A counterweight carriage in accordance with claim 3, wherein said guide member includes a vertical beam of substantially rectangular cross-section with a longitudinal opening provided along one side thereof, said guide means received in said opening with said wheels adapted to engage the interior sides of said vertical beam.

5. A counterweight carriage in accordance with claim 4, wherein said guide member defines a slot opposite said opening, said slot adapted to receive a splice bar which is provided for splicing and aligning separate lengths of said vertical beam whereby they are connected in abutting relationship end to end.

6. A counterweight carriage in accordance with claim 1, wherein said connection means comprises a slot having a cruciform-shaped cross-section with crossed horizontal and vertically disposed spaces, supporting structure for the carriage received in said cruciform-shaped slot which includes a horizontal extending portion received in said horizontal space and a vertically extending portion received in the lower aspect of said vertical space.

7. A counterweight carriage in accordance with claim 6, wherein said horizontally extending portion comprises a plate with an opening therein and said vertically extending portion comprises a cable received through said opening which includes an enlarged portion in the lower aspect of said vertical space which is unable to pass through said opening.

8. A counterweight carriage in accordance with claim 6, wherein said horizontally extending portion received in said horizontal space comprises an enlarged portion of a cable and said vertically extending portion received in the lower aspect of said vertical space includes a nonenlarged portion of said cable.

9. A counterweight carriage in accordance with claim 6, wherein said vertically extended portion comprises a vertically disposed plate having at least one opening at the same level of said horizontal space, said horizontally extending portion comprising a member extending through said opening into said horizontal space.

10. An extruded rod of uniform cross-section for use as a vertical guide for a counterweight carriage in combination with a vertical guide beam cooperating therewith, the rod comprising: a tongue for receiving weight members with notches corresponding to said tongue disposed along one longitudinal edge; guide means disposed along the other longitudinal edge, said guide means comprising a vertical column connected inwardly to said tongue and defining a longitudinally extending notch opposite said tongue; and a pair of oppositely directed longitudinally extending flanges extending outwardly from said connection of said tongue and said vertical column; a guide beam extending parallel and adjacent to the rod, said column movably engaging said guide beam.

11. A rod in accordance with claim 10, wherein wheels are mounted on axles journalled in said column, said wheels adapted to roll on said guide beam when the rod is moved relative thereto.

12. A rod in accordance with claim 11, wherein said guide beam is provided with track means adapted to engage said wheels.

13. A rod in accordance with claim 12, wherein said track means comprises a pair of tracks provided on opposite sides of said wheels, said tracks being spaced apart by a distance slightly greater than the diameter of said wheels whereby each of said wheels can engage only one said track at the time.

14. A rod in accordance with claim 10 which comprises one side of the counterweight frame, a like rod being provided on the opposite side of the frame including a tongue receiving a corresponding notches in the aforementioned weight members opposite their aforesaid corresponding notches.

* * * * *